US005343934A

United States Patent [19]

Wilson

[11] Patent Number: 5,343,934

[45] Date of Patent: Sep. 6, 1994

[54] MULTIPLE PINCH ROLL APPARATUS AND METHOD FOR ADVANCING A CONTINUOUS ROD

[75] Inventor: Thomas N. Wilson, Carrollton County, Ga.

[73] Assignee: Southwire Company, Carrollton, Ga.

[21] Appl. No.: 11,588

[22] Filed: Feb. 1, 1993

[51] Int. Cl.[5] ..... B21B 1/46; B21B 13/22; B22D 11/12

[52] U.S. Cl. ..... 164/476; 164/417; 164/442; 164/477; 164/484; 226/177; 226/189

[58] Field of Search ..... 164/484, 448, 442, 476, 164/417, 477; 242/82, 83; 226/189, 176, 177

[56] References Cited

U.S. PATENT DOCUMENTS

| | | | |
|---|---|---|---|
| 3,543,830 | 12/1970 | Baumann | 164/484 |
| 3,683,998 | 8/1972 | Novikov et al. | 164/484 |
| 3,776,298 | 12/1973 | Vogt | 164/442 X |
| 4,042,010 | 8/1977 | Komma et al. | 164/442 |
| 4,232,727 | 11/1980 | Bower et al. | 164/484 X |
| 4,476,915 | 10/1984 | Rahmfeld et al. | 164/484 |
| 5,018,569 | 5/1991 | Burau et al. | 164/451 X |

FOREIGN PATENT DOCUMENTS

| | | | |
|---|---|---|---|
| 1288250 | 1/1969 | Fed. Rep. of Germany | 164/448 |
| 1290668 | 3/1969 | Fed. Rep. of Germany | 164/448 |
| 46-13511 | 4/1971 | Japan | 164/448 |

*Primary Examiner*—J. Reed Batten, Jr.

*Attorney, Agent, or Firm*—James W. Wallis, Jr.; Stanley L. Tate; George C. Myers, Jr.

[57] ABSTRACT

Multiple pairs of pinch rolls are used to advance a rod product along a pathway following a continuously casting and rolling system. Each pinch roll pair exerts a force normal to the rod of less than the amount necessary to substantially degrade the yield strength characteristics of the finished rod. Multiple driven pinch roll pairs cooperate to advance the rod by compressive engagement and accomplish the work of one or two pairs of pinch rolls to minimize work hardening and/or plastic deformation, which can result in an increase in yield strength. Yield strength characteristics are thus improved while the continuous rod product is still advanced and guided at very high speed along a pathway from a horizontal to a vertical direction.

33 Claims, 4 Drawing Sheets

MULTIPLE PINCH ROLL APPARATUS AND METHOD FOR ADVANCING A CONTINUOUS ROD

FIELD OF THE INVENTION

The present invention relates to continuous casting and rolling of elongated metal rod products. More particularly, this invention relates to improvements in the apparatus and methods for in-line handling of the rod product to minimize work hardening of the rod product.

BACKGROUND OF THE INVENTION

Continuous casting and rolling systems for non-ferrous metals, including copper, have been known for many years. These continuous rod production systems generally include apparatus for providing a continuous stream of molten metal to a casting machine in which the metal is solidified as a continuous cast bar, then passed through an in-line continuous rolling mill, an in-line rod cleaning apparatus, and a coiling machine where the finished rod product is collected for transport to further processing stations or for shipment.

The copper rod systems pioneered by the assignee of this invention initially produced copper rod at a production rate of about 10 tons per hour, and now produce higher-quality rod at much greater capacities. The success of such systems is based on the vastly improved copper rod product produced thereby and on the economic advantages resulting from the continuous nature of the rod production process. Similar continuous rod systems are available for other non-ferrous products, such as aluminum and aluminum alloy rod, as well as for ferrous products. Because manufacturing economies are related to system speed improvements, production rate limitations of any of the system elements limits further improvements in the economy of the system as a whole; thus high-productivity system elements are more desirable. However, handling of the very rapidly advancing rod produced by such systems may introduce undesirable product qualities, e.g., from work hardening and/or plastic deformation of the product.

Referring to FIGS. 1–5 there is shown an example of a conventional continuous metal casting and rolling system 10, in which molten metal is supplied by a melting means 11 to a pouring means 14, poured into a mold comprising a peripheral groove in a rotating casting wheel 12 and a casting band 13 which covers a portion of the casting wheel periphery to form a continuously advancing mold. Coolant is applied to the closed portion of the moving mold to solidify the molten metal, forming a continuously cast bar 15, which is guided away from the casting machine by a cast bar conveyer 16 and directed to subsequent operations. A shear 17 is used to sever sections of the cast bar 15, as may be required during manufacturing operations. The cast bar 15 may be routed through pre-rolling station 18 which may comprise an initial bar treatment apparatus. The cast bar is then directed into rolling mill 19, in which a plurality of roll stations work the cast bar, reducing its cross sectional area and elongating it to form a continuously advancing rod product 22. A delivery pipe 20 (see also FIG. 2) in which cooling, thermal, and/or chemical treatments may be performed, guides the continuously cast and rolled rod product 22 to a turndown 54 and thence into a coiler station 21, where the rod is collected into coils 23 for convenient handling and storage or shipment.

An early arrangement of the coiler station 21 is shown in FIG. 2. From rolling mill 19 the rod product is directed to a pair of pinch rolls 24 via a pathway such as delivery pipe 20. From the pinch rolls 24, the rod 22 is directed from horizontal axis 40 through turndown feed tube 54 to a vertical axis 32 downwardly into a flyer tube 31 from which it is laid into coils in a known manner.

A rollerized guide described in U.S. Pat. No. 4,068,705 is shown in FIGS. 3 and 4 hereof. The rod 22 in such apparatus passes into a guide mechanism 25 which functions to guide the rod from a substantially horizontal direction of movement along axis 40 toward a substantially vertical direction of movement along axis 32. As shown in FIG. 4 hereof, rod guide mechanism 25 includes a pair of arcuate side plates 215 and 216 which support a series of spaced apart rollers **218*a*, 218*b*, 218*c*, etc., and an arcuate rod conduit 219. Arcuate rod conduit 219 is generally tubular and includes a series of spaced slots 220 along its upper convex surface. Rollers 218*a*, etc. are supported by arcuate side plates 215 and 216 so that their peripheries extend into slots 220. The rod passing through rod conduit 219 normally would engage the concave surface of the rod conduit 219; however, rollers 218*a*, etc., function to hold the rod away from the surface of rod conduit 219, and isolate the rod from the sliding friction it normally would encounter when it engages the surface of rod conduit 219. Rollers 218*a*, etc., are mounted on ball bearings and are relatively friction-free. Thus, the rod passing through rod guide mechanism 25** is directed through a 90° arc with a minimum of friction.

Rollers 218 are spaced at approximately 10° intervals from each other through the 90° arc defined by the rod guide mechanism 25. This close spacing of the rollers is such that the initial leading end of the rod passing through the system will normally not engage the surface of rod conduit 219 of rod guide mechanism 25, but will be positively guided in a downward direction by the rollers.

Entrance guide tube 221 is connected to arcuate rod conduit 219 along rod path 40. The end 222 of entrance guide tube 221 may be flared outwardly to receive the leading end of the rod passing along path 40 and guide the rod into rod guide mechanism 25. Similarly, exit guide tube 224 is positioned adjacent the vertical end of rod guide mechanism 25, and includes a flared end 225 which receives the rod from rod guide mechanism 25. Exit guide tube 224 guides the rod 22 in a vertical direction along axis 32 toward, for example, a coiler below.

A portion of an improved rollerized turndown 35 similar to that described in U.S. Pat. No. 4,944,469 is shown in FIG. 5, wherein a plurality of freely rotatable roll pairs, such as roll pair 33, 34, guide the rod 22 from pinch roll 24 down to the coiler 21 along vertical axis 32. This arrangement may include a second pinch roll pair 26 arranged along the vertical axis 32.

It is believed that ferrous rod may undergo a similar horizontal-to-vertical transition in certain other rod rolling mill installations, wherein, after rolling, the rod is passed around a large rotating wheel. This is illustrated generally in FIG. 6. The wheel 300 includes an exit pinch roll 304 for retaining the rod 22 in contact with the wheel 300. It is also believed that in certain rolled rod installations, a V-grooved wheel may be used for a similar purpose, and may include an exit pinch roll 304 to ensure contact of the advancing rod with the wheel.

Rod pinch rolls, such as the pinch rolls 24 shown in FIGS. 2 and 5, are used to pull finished rod from a rod mill and to assist in conveying the rod to the next in-line station, such as a coiler. A certain amount of pulling force is required to pull, or to push, the rod. This pulling force is produced by a coefficient of friction between the rod and the pinch roll surface multiplied by the force normal to the rod. In the case of a relatively soft material, such as copper, the force normal to the rod may be enough to deform the rod, thereby working the soft metal, and thus raising the yield strength of the rod. An increase of yield strength may be detrimental to the subsequent operations performed on rod, such as drawing the rod into wire, and is preferably avoided.

It has been determined that the coiled rod product made according to the above-described prior art apparatus has a substantially greater yield strength than the as-rolled rod product, especially in high speed rod systems which require substantially greater pinch roll pressure. While this is normally acceptable for most applications, in certain instances, it would be desirable if the yield strength were maintained at or near that existing as the rod exits the rolling mill and is cooled.

Hot "dead soft" copper rod exiting the rolling mill, if cooled and unworked, exhibits a yield strength below about 10,000 pounds per square inch (psi), which may be more desirable in certain subsequent manufacturing operations. It is therefore desirable to minimize unnecessary increases in yield strength during the rod processing operations.

It has been determined that the coiled continuous cast and rolled rod product from the prior art apparatus normally exhibits a tensile yield strength of about 17,000 to about 20,000 psi, while it is known that unworked, unhardened, or "dead soft" copper rod exhibits a tensile yield strength of about 8,000 to about 10,000 psi after exiting the rod mill at about 1100° F. and then cooled. The cause of the increased yield strength is work hardening and/or plastic deformation of the hot rod product that occurs in the pinch rolls and turndown portion of the apparatus.

SUMMARY OF THE INVENTION

Briefly described, the present invention comprises apparatus for redirecting the continuously advancing rod downwardly in a passageway defined by a plurality of continuously rotated pinch roll pairs. The multiple pinch roll pairs engage the rod lightly but firmly so as to divert and advance the rod along a path from a first, substantially horizontal pathway to a second substantially vertical pathway. While it is preferred that all the roll pairs positively drive the rod along the desired path, less than all of the roll pairs may be driven. Among the driven roll pairs, the rotational speeds may vary between the rolls of each pair to accommodate the slight variation in rod surface speeds that occur about the turndown arc.

It is a feature of the present invention that all or substantially all of the plurality of roll pairs lightly grip the rod for advancement thereof along the path formed by the roll pairs.

A major advantage arising from use of a plurality of driven rolls which lightly engage the rod is significantly reduced work hardening and/or plastic deformation of the advancing rod. This results in a rod product of a lower yield strength (approaching "dead-soft" rod) than is possible with the prior art apparatus.

A continuous cast, rolled, and coiled rod which exhibits lower yield strength characteristics is produced by the method which includes the steps of redirecting the rod along a path of travel by passing it over the periphery of at least one inner roll having a rotational axis, engaging the rod product against the periphery of the at least one inner roll with at least three outer rolls, each of which has rotational axis, applying a compressive force to the rod product with each of the outer rolls, and rotating the rolls to advance the rod. The total compressive force may be divided substantially equally among the outer rolls. The work hardening can thereby be reduced to avoid unnecessary compressive force, resulting in a copper rod product exhibiting less than about 16,000 psi and preferably less than about 13,000 psi after exiting the rolls. The rolls can be arranged along a curved path. Of course, the inner and outer roll paths will have different radiuses; thus, it may be necessary to rotate the outer rolls faster than the inner rolls.

With the foregoing and other objects, advantages, and features of the invention which will become hereinafter apparent, the nature of the invention may be more clearly understood by reference to the following detailed description of the invention, the appended claims, and to the several views illustrated in the attached drawings.

DETAILED DESCRIPTION OF THE INVENTION

Figure 1:
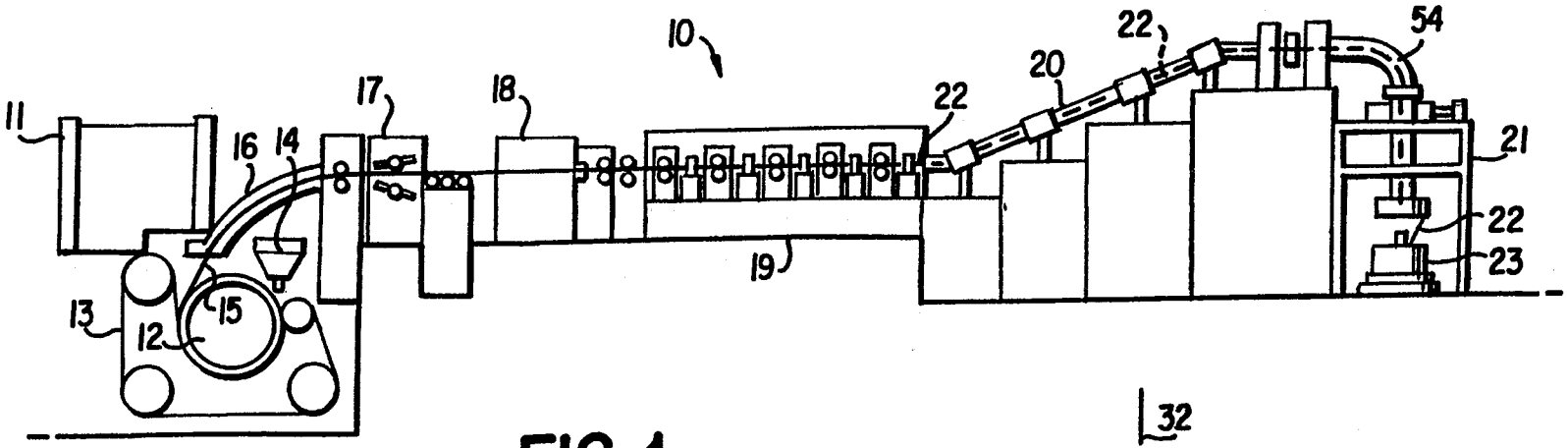
FIG. 1 (PRIOR ART)
FIG. 1 is a schematic illustration of a conventional continuous casting and rolling apparatus with which the present invention may be practiced.
Figure 2:
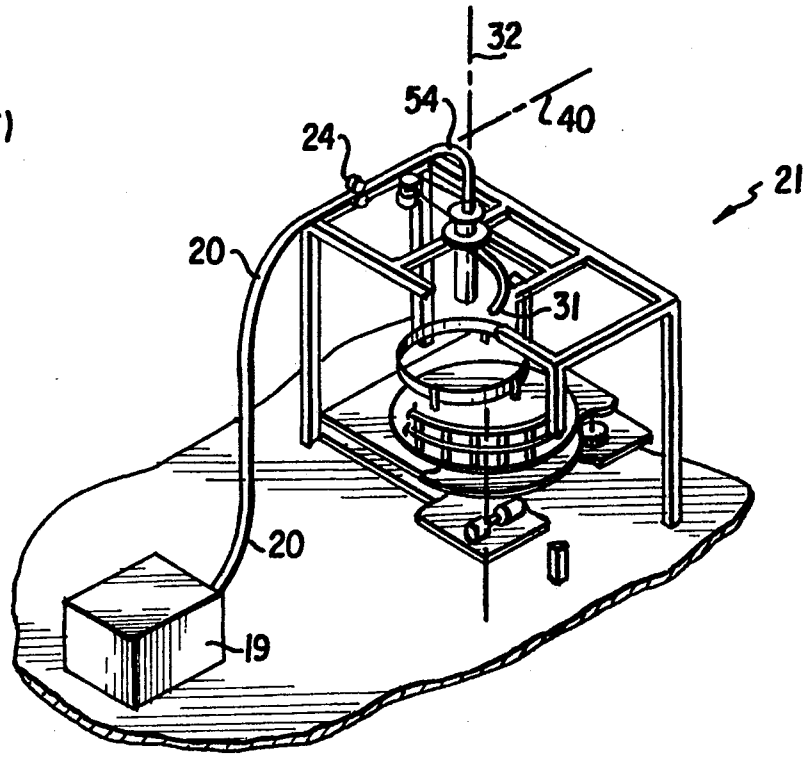
FIG. 2 (PRIOR ART)
FIG. 2 is a perspective view of a prior art delivery tube and coiler following a continuous rolling mill.
Figure 3:
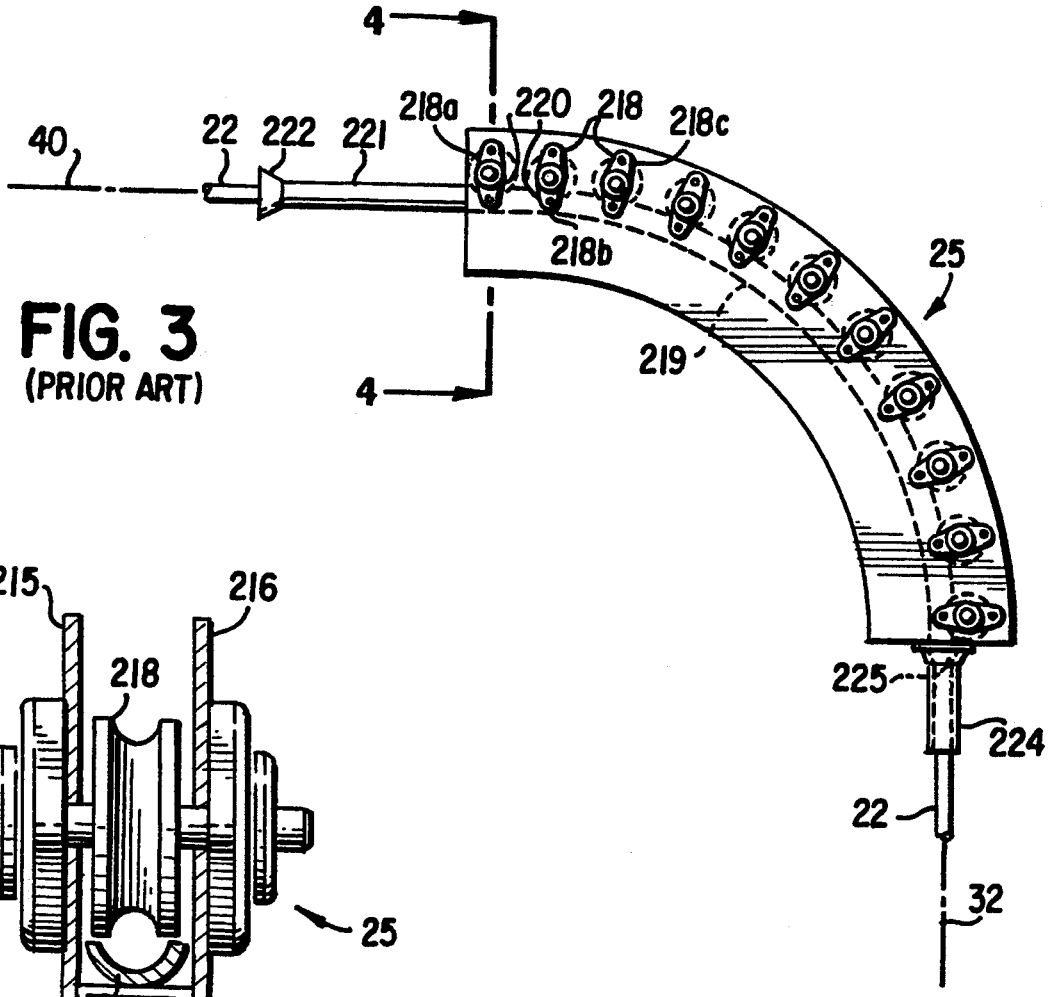
FIG. 3 (PRIOR ART)
FIG. 3 is a side elevation view of a rollerized turndown of the prior art.
Figure 4:
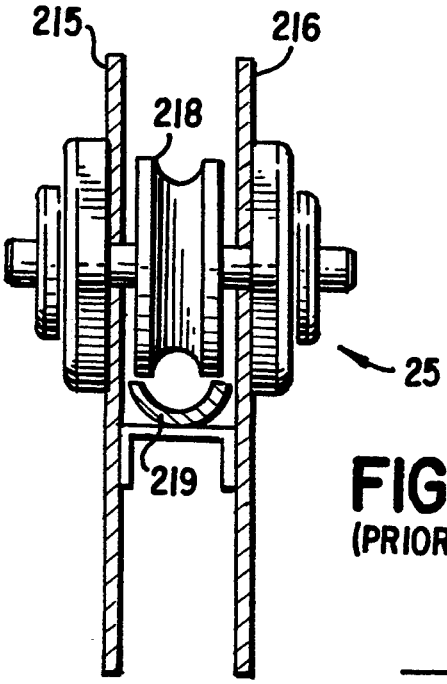
FIG. 4 (PRIOR ART)
FIG. 4 is a cross-sectional view of the turndown of FIG. 3 taken along line 4—4.
Figure 6:
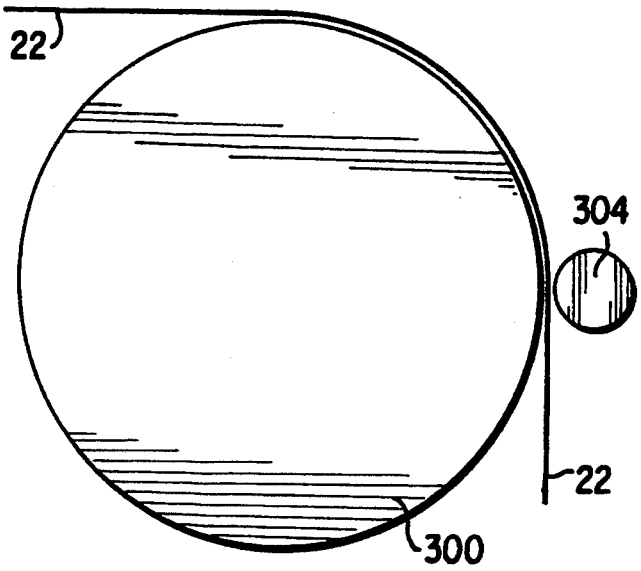
FIG. 6 (PRIOR ART)
FIG. 6 illustrates another known apparatus for redirecting rod from a horizontal entry to a vertical exit orientation.
Figure 5:
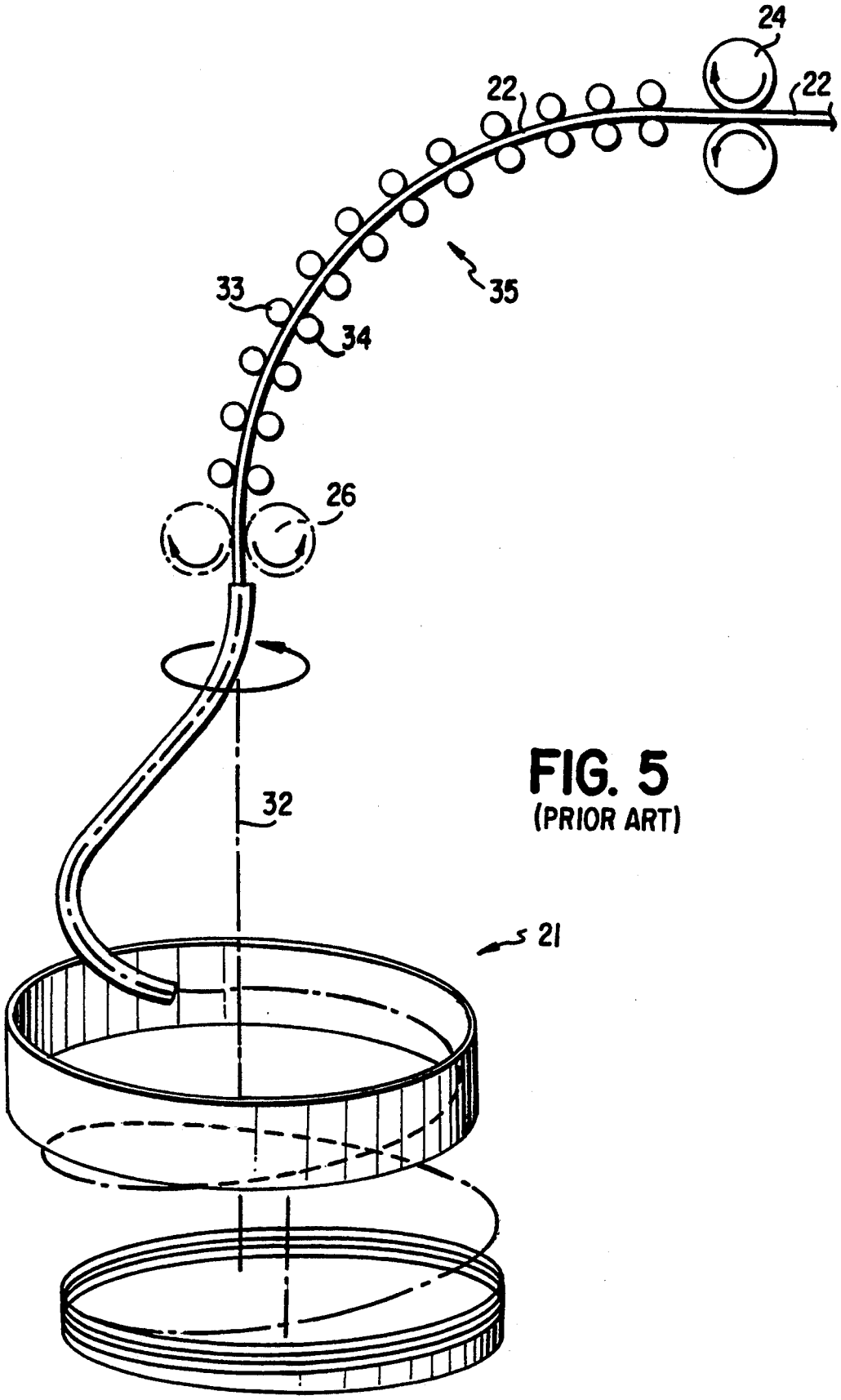
FIG. 5 (PRIOR ART)
FIG. 5 illustrates another prior art rollerized turndown and coiler guide.
Figure 7:
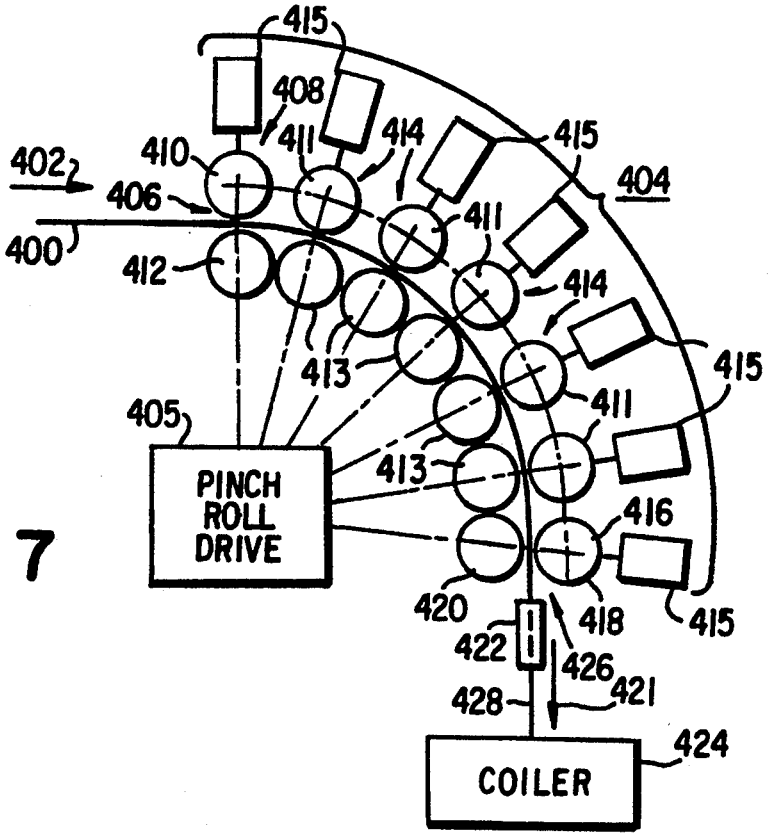
FIG. 7 is a schematic side elevation view of the turndown according to a preferred embodiment of the present invention.

The present invention is illustrated schematically in FIG. 7, wherein the rod 400, traveling in horizontal direction 402, enters the turndown 404 at an entry 406 into an initial or entry pair 408 of driven pinch rolls comprising outer entry pinch roll 410 and inner entry pinch roll 412. Entry roll pair 408 is followed by successive pluralities of roll pairs 414 comprising rolls 411, 413 and an exit roll pair 416 comprising rolls 418, 420. All of the rolls are preferably driven by a pinch roll drive 405 as schematically shown in dashed lines. The pinch roll pairs 408, 414, 416 each engage the rod 400 with a slight compressive force substantially less than the force of the prior art pinch roll pair. The compressive force may be applied to the roller pairs by means of air cylinders or other mechanisms 415 depicted schematically in FIG. 7.

The inner rolls 412, 413, 420 of each roll pair may be rotatably mounted along fixed axes and the outer rolls 410, 411, 418 may be rotatably mounted along movable axes which are moved toward and away from the inner rolls by means of the air cylinders 415. The force applied to each movable roll by the air cylinders 415 is preferably in the range of from about 25 to about 250 pounds and more preferably in the range of from about 25 to about 50 pounds. It is not essential that the force applied to each movable roll be equal, although the more uniform the distribution of force among the roll pairs the more likely the optimum result of minimum increase in yield strength will be achieved.

Not all of the roll pairs must necessarily compressively grip the rod 400 or be driven to accomplish the objective of the present invention. That is, some of the roll pairs may merely contact the rod for the purpose of redirecting it, rather than for the purpose of gripping and advancing it along the curved pathway. Driving all the roll pairs, whether they engage the rod with a compressive force or not, may be preferable. The rolls in such case should preferably be driven at the same peripheral contact speed (i.e., at the same speed at the point of contact with the rod) as the advancing rod speed. It will be appreciated that the greater the number of driven roll pairs that grip the rod with a compressive force, the less the gripping force necessary for any given roll pair with the result that the rod will be work hardened to a lesser extent and the yield strength will not be increased significantly.

After the entry pinch roll pair 408 and successive roll pairs 414, the exit roll pair 416 comprising outer roll 418 and inner roll 420 directs the rod in direction 421, where it normally enters into a flyer tube 422 (partly shown) associated with coiler 424. Coiler 424 is shown schematically as there are many variations in coiler design. The exit rolls are preferably (but not necessarily) configured as a pinch roll pair. At least some of the successive roll pairs 414 are powered by pinch roll drive 405 and compressively engage the rod 400.

The diameter of the rolls of roll pairs 408, 414, and 416 is selected according to the desired turndown radius, rod speed, and at least the minimum number of pinch roll pairs which is required to advance the rod along the curved pathway at the desired speed. Driven pinch rolls may vary within a range of about 1 inch radius to about 4 inches radius, measured from their axes radially to the point of contact with the rod 400. It may be desirable to drive all the roll pairs at the same speed and vary the diameter of the rolls to match the angular velocity of the rolls at their contact point with the rod to the rod velocity at that point. In other words, the diameters of the inner rolls of each roll pair 414 may be slightly smaller than the diameters of the outer rolls of the roll pairs 414 since the surface velocity of the rod engaging the outer rolls is slightly greater than the surface velocity of the rod engaging the inner rolls.

It should be understood that the greater the number of driven pinch roll pairs engaging the rod, the less compressive force is generally required for each driven pinch roll pair. Similarly, the surface velocity and diameter of the pinch roll pairs may vary from the entry roll pair 406 to the exit roll pair 416. The angular velocity of the driven roll pairs at the points of contact of the rolls with the rod is preferably matched to the expected speed of the advancing rod, either by varying the driven speed of the rolls or by varying the roll diameters. After the rod engages in the turndown 404, the speed of the pinch roll drive 405 may be adjusted to the desired value consistent with the rod velocity exiting the rolling mill.

In a variation (see FIG. 8) of the preferred embodiment of the turndown 404 previously described, a single, larger diameter roll 430 may be substituted for all or some of the inner rolls, such as entry and exit rolls 412, 420, and for the inner rolls 413 of the intervening roll pairs 414 in turndown 404. In the FIG. 8 embodiment, the single larger roll 430 precludes varying the speed and/or diameter of the rolls of the inner diameter roll 430; a single speed is therefore required.

Roll 430 may include a peripheral groove or edge guides to facilitate location and engagement of the rod 400 with the roll. The pathway of rod 400 may be associated with a greater or lesser arc than the 90° arc shown in FIG. 8, as desired, for example, to accommodate a transition of less or greater than 90°. Roll 430 has a diameter in a range of from about 2 feet to about 16 feet, and preferably in a range of from about 3 feet to about 10 feet.

Figure 8:
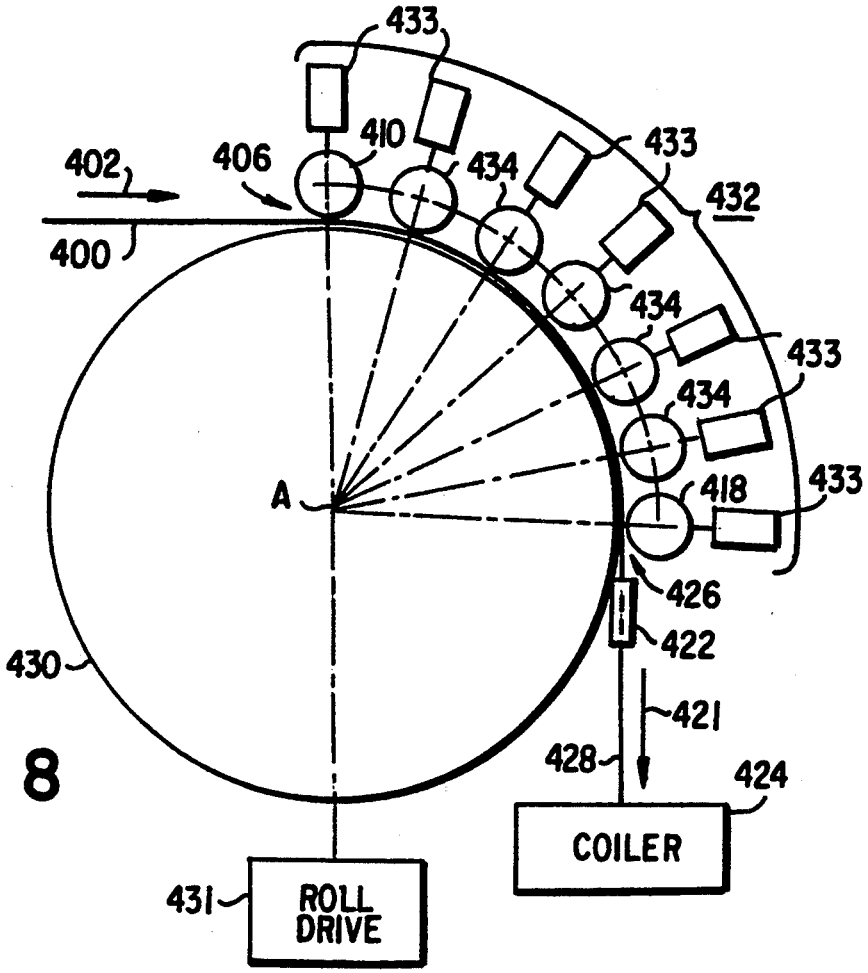
FIG. 8 is a schematic side elevation view of a turndown according to an alternate embodiment of the present invention.

Preferably, roll 430 and the rolls 410, 434, and 418 are driven by a roll drive 431 schematically shown in FIG. 8 by the dashed lines. Some or all of the rolls 410, 434, and 418 are movable toward and away from the rotational axis A of the large roll 430 by means of air cylinders 433 or other suitable mechanism so as to compressively engage the rod 400 against the periphery of roll 430 with a force sufficient to pull the rod from the rolling mill and push it into the coiler tube 422 of the coiler 424. The force to be applied to each of the rolls is governed by the same considerations as discussed above in connection with the embodiment of FIG. 7.

In view of the foregoing, it should be apparent that there is provided in accordance with this invention a turndown incorporating a plurality of outer rolls and at least one inner roll cooperating to form a pathway for a rapidly advancing rod, in which the rolls compressively engage the rod and are driven to advance the rod along a pathway from a substantially horizontal direction to a substantially vertical down direction.

Although certain presently preferred embodiments of the invention have been described herein, it will be apparent to those skilled in the art to which the invention pertains that variations and modifications of the described embodiment may be made without departing from the spirit and scope of the invention. Accordingly, it is intended that the invention be limited only to the extent required by the appended claims and the applicable rules of law.

What is claimed is:

1. Apparatus for advancing a continuous metal rod product from a continuous casting and rolling system along a path of travel comprising at least one inner roll having a periphery over which said rod product passes and a plurality of at least three outer rolls each engageable with said rod product as it passes over the periphery of said at least one inner roll, means for moving said inner roll and said plurality of outer rolls relative to one another so as to apply a light compressive force to the rod product between said inner roll and each of said outer rolls, each of said rolls having a rotational axis and means coupled to at least some of said rolls for rotating such rolls about their respective rotational axes, whereby the rod product is conveyed along said path by the rotation of said rolls and the compressive force applied thereto by said plurality of rolls, comprising a single inner roll, wherein a portion of the periphery of said inner roll defines said path of travel, each outer roll engaging said rod product against the periphery of said inner roll on said path of travel, said moving means comprising means for urging said outer rolls toward the rotational axis of said inner roll to apply thereby a compressive force to said rod product at each of said outer rolls.

2. Apparatus according to claim 1, wherein said at least one inner roll comprises a plurality of inner rolls corresponding in number to said plurality of outer rolls, each inner roll engaging said rod product between the periphery thereof and the periphery of a respective outer roll, each of said inner rolls and its corresponding outer roll defining a pinch roll pair.

3. Apparatus according to claim 2, comprising at least seven inner pinch roll pairs.

4. Apparatus according to claim 2, wherein said moving means includes means for urging each of said outer rolls relative to a respective one of said inner rolls to control the compressive force on said rod by each pinch roll pair.

5. Apparatus according to claim 4, wherein said urging means comprises an air cylinder coupled to the outer roll of each pinch roll pair.

6. Apparatus according to claim 4, wherein said compressive force is in a range of from about 25 to about 250 pounds.

7. Apparatus according to claim 4, wherein said compressive force is in a range of from about 25 to about 50 pounds.

8. Apparatus according to claim 1, wherein said path of travel is a curved path.

9. Apparatus according to claim 8, wherein said curved path extends through an angle of about 90° from a substantially horizontal direction to a substantially vertical direction.

10. Apparatus according to claim 1, wherein said inner roll has a diameter of from about two feet to about sixteen feet.

11. Apparatus according to claim 1, wherein said inner roll has a diameter of from about two feet to about five feet.

12. Apparatus according to claim 1, wherein said rod product is copper rod.

13. A method of conveying a continuous rod product from a continuous casting machine and rolling mill along a path of travel to a coiler comprising the steps of:

passing the rod product over the periphery of at least one inner roll having a rotational axis;

engaging the rod product against the periphery of said at least one inner roll with a plurality of at least three outer rolls, each having rotational axes;

applying a compressive force to the rod product with each of said outer rolls and said at least one inner roll; and rotating said rolls about their respective rotational axes.

14. The method of claim 13, wherein the total compressive force applied to the rod product is distributed among said at least one inner roll and said at least three outer rolls such that an increase in yield strength of the rod product resulting from work hardening by compressive force is minimized.

15. The method of claim 14, wherein said rod product is copper rod and the yield strength of said copper rod is maintained below 16,000 psi after the rod product passes through all of said rolls.

16. The method of claim 14, wherein said rod product is copper rod and the yield strength of said copper rod is maintained below 13,000 psi after the rod product passes through all of said rolls.

17. The method of claim 13, including a plurality of inner rolls corresponding in number to the number of outer rolls, said inner and outer rolls being arranged in a curved path of travel, and further including the step of rotating said inner rolls at a velocity different from the velocity of said outer rolls.

18. The method of claim 13, including the step of rotating said rolls at velocities which substantially match the velocity of the rod product at the point of engagement of the rolls with the rod product.

19. The method of claim 14, including only one inner roll, said plurality of outer rolls engaging the rod product against the inner roll periphery with a total compressive force distributed among said inner roll and said plurality of outer rolls, and further including the step of rotating said inner roll at a velocity different from the rotational velocity of the outer rolls.

20. Apparatus for conveying a continuous metal rod product from a continuous casting and rolling system along a path of travel comprising a single inner roll having a periphery over which said rod product passes and a plurality of at least three outer rolls each engageable with said rod product as it passes over the periphery of said one inner roll, means for moving said plurality of outer rolls relative said inner roll so as to apply a compressive force to the rod product between each of said outer rolls and said inner roll, each of said rolls having a rotational axis and means coupled to at least some of said rolls for rotating such rolls about their respective rotational axes, whereby the rod product is advanced along said path by the rotation of said rolls and the engagement forces applied thereto by said plurality of rolls.

21. Apparatus according to claim 20, wherein said rod product is copper rod, wherein a limited circumferential portion of the periphery of said inner roll defines said path of travel, each outer roll engaging said copper rod product against the periphery of said inner roll on said path of travel, said moving means comprising means for urging said outer rolls toward the rotational axis of said inner roll to grippingly engage and advance said copper rod product at each of said outer rolls.

22. Apparatus according to claim 20, wherein said inner roll has a diameter of from about two feet to about sixteen feet.

23. Apparatus according to claim 20, wherein said inner roll has a diameter of from about two feet to about five feet.

24. Apparatus according to claim 20, wherein said moving means includes means for urging each of said outer rolls relative to said inner roll to control the engagement forces of said rod by each outer roll.

25. Apparatus according to claim 24, wherein said urging means comprises an air cylinder coupled to each of said outer rolls.

26. Apparatus according to claim 20, wherein said means for moving and said means for rotating cooperate to lightly but firmly engage the rod product with each of said outer rolls and said at least one inner roll.

27. A continuous metal casting and rolling system, comprising:

a) a continuous casting machine followed by a rod rolling mill producing a continuous rod product;

b) apparatus for conveying the continuous rod product from the rolling mill along a path of travel, further comprising:

i) at least one inner roll having a periphery over which said rod product passes and a plurality of at least three outer rolls each engageable with said rod product as it passes over the periphery of said at least one inner roll, ii) means for moving said inner roll and said plurality of outer rolls relative to one another so as to apply a compressive force to the rod product between said inner roll and each of said outer rolls, each of said rolls having a rotational axis, iii) means coupled to at least some of said rolls for rotating such rolls about their respective rotational axes, whereby the rod product is advanced along said path by the rotation of said rolls and the compressive force applied thereto by said plurality of rolls; and c) means for coiling the rod product.

28. Apparatus according to claim 27, wherein said means for moving and said means for rotating cooperate to lightly but firmly engage the rod product with each of said outer rolls and said at least one inner roll.

29. Apparatus according to claim 27, wherein said at least one inner roll comprises a plurality of inner rolls corresponding in number to said plurality of outer rolls, each inner roll engaging said rod product between the periphery thereof and the periphery of a respective outer roll, each of said inner rolls and its corresponding outer roll defining a pinch roll pair.

30. Apparatus according to claim 27, wherein said path of travel is a curved path.

31. The method of conveying a continuous rod product from a rolling mill along a path of travel to a rod coiling means in a continuous metal casting and rolling system, comprising the steps of:

a) passing the rod product over the periphery of at least one inner roll having a rotational axis;

b) engaging the rod product against the periphery of said at least one inner roll with a plurality of at least three outer rolls, each having rotational axes;

c) applying a minimal compressive force to the rod product with each of said outer rolls and said at least one inner roll to lightly but firmly engage the rod product; and d) rotating said rolls about their respective rotational axes to advance said rod product.

32. The method of claim 31, wherein the step of applying a compressive force is accomplished with means for moving said plurality of outer rolls relative to said inner roll so as to apply a compressive force, wherein the compressive force applied is minimized to limit work hardening of the rod product.

33. The method of claim 31, wherein said rod product is copper rod and the yield strength of said copper rod is maintained below 16,000 psi after the rod product passes through all of said rolls.

* * * * *